US008522731B2

(12) United States Patent
Ito et al.

(10) Patent No.: US 8,522,731 B2
(45) Date of Patent: Sep. 3, 2013

(54) CYLINDER HEAD OF WATER-COOLED INTERNAL COMBUSTION ENGINE AND METHOD OF MANUFACTURING SAME

(75) Inventors: Kenji Ito, Saitama (JP); Shinichiro Sugimoto, Saitama (JP); Kazuhiro Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 499 days.

(21) Appl. No.: 12/817,975

(22) Filed: Jun. 17, 2010

(65) Prior Publication Data

US 2010/0319637 A1 Dec. 23, 2010

(30) Foreign Application Priority Data

Jun. 17, 2009 (JP) ..... 2009-143893

(51) Int. Cl.
*F02F 1/36* (2006.01)
*F02F 1/42* (2006.01)

(52) U.S. Cl.
USPC ..... 123/41.82 R; 123/193.5; 29/888.06

(58) Field of Classification Search
USPC ..... 123/41.82 R, 41.74, 41.31, 41.84, 123/41.1, 41.44, 496, 193.2, 193.5; 29/888.061, 29/888.01, 888.06
See application file for complete search history.

(56) References Cited

U.S. PATENT DOCUMENTS

| | | | | |
|---|---|---|---|---|
| 4,394,850 | A * | 7/1983 | Hayashi | 123/41.74 |
| 5,765,282 | A | 6/1998 | Sweetland et al. | |
| 7,640,898 | B2 * | 1/2010 | Tsubouchi et al. | 123/41.82 R |
| 2007/0227473 | A1 * | 10/2007 | Tsubouchi et al. | 123/41.31 |

FOREIGN PATENT DOCUMENTS

| | | | |
|---|---|---|---|
| DE | 3802886 | A1 | 8/1988 |
| DE | 10154096 | A1 | 5/2003 |
| DE | 20320581 | U1 | 12/2004 |
| JP | 2001-107729 | | 4/2001 |

OTHER PUBLICATIONS

European Search Report for Application No. 10165875.5, dated Aug. 27, 2010.

* cited by examiner

*Primary Examiner* — Noah Kamen
(74) *Attorney, Agent, or Firm* — Nelson Mullins Riley & Scarborough LLP; Anthony A. Laurentano

(57) ABSTRACT

A cast cylinder head 1 of an internal combustion engine to be mounted on a vehicle has an intake-side side wall 2*i*, an exhaust-side side wall 2*e*, and opposite end walls 3*r* and 3*f*. The walls 2*i*, 2*e*, 3*r* and 3*f* define a water jacket 8. A first cooling water exit part 11 and a second cooling water exit part 21 both having a solid structure are formed by casting integrally with one of the intake-side side wall 2*i* and the exhaust-side side wall 2*e* and with one of the end walls 3*r* and 3*f*, respectively. Cooling water exit openings 15,16 or 25,26 opening into the water jacket 8 are drilled selectively in either of the first cooling water exit part 11 and the second cooling water exit part 21 depending on the engine mounting position on the vehicle. Thus the same cylinder head can be used independently of the mounting orientation of the engine on the vehicle.

11 Claims, 10 Drawing Sheets

CYLINDER HEAD OF WATER-COOLED INTERNAL COMBUSTION ENGINE AND METHOD OF MANUFACTURING SAME

BACKGROUND OF THE INVENTION

1. Field of the Invention

The present invention relates to a cylinder head with a water jacket, of a water-cooled internal combustion engine to be mounted on motor vehicles, and a method of manufacturing the cylinder head.

2. Description of the Related Art

Some type of water-cooled internal combustion engines are mounted on a motor vehicle in a longitudinal position with the crankshaft thereof extended longitudinally of the vehicle and some other type of water-cooled internal combustion engines are mounted on a motor vehicle in a transverse position with the crankshaft thereof extended transversely of the vehicle. Flow of cooling water in the cylinder head of an internal combustion engine dominates the mode of installation of the internal combustion engine in a vehicle; that is, an internal combustion engine designed for longitudinal installation cannot be transversely installed, and vice versa.

A water-cooled internal combustion engine is cooled by an intake preferential cooling system that controls the flow of cooling water in the cylinder head so that intake air is cooled preferentially to achieve a high compression ratio to suppress knocking or by an ordinary cooling system. Flow of cooling water in such an internal combustion engine limits the installing position of the engine to either of longitudinal and transverse installing positions.

A prior art cylinder head has a water jacket provided with a plurality of cooling water exit openings, one of which is used selectively for the cooling system (see JP-2001-107729 A). The cylinder head of such construction reduces the manufacturing cost of the cylinder head.

The plurality of cooling water exit openings of this previously proposed cylinder head disclosed in JP-2001-107729 A are formed during the manufacture of the cylinder head. Some of the cooling water exit openings are plugged up with detachable plugs and the rest are left open to form a desired flow of cooling water in the cylinder head.

This prior art cylinder head needs plugs or covers to block up some of cooling water exit openings and sealing members for water-tight blocking of the cooling water exit openings. Consequently, the cylinder heads needs additional parts and troublesome blocking work. Formation of the plurality of cooling water exit openings during the manufacture of the cylinder head needs many man-hours for machining and increases the manufacturing cost.

SUMMARY OF THE INVENTION

The present invention has been made in view of such problems and it is therefore an object of the present invention to provide a cylinder head of a water-cooled internal combustion and a method of manufacturing the cylinder head, which cylinder head can be used for both a water-cooled internal combustion engine to be installed in a longitudinal position and a water-cooled internal combustion engine to be installed in a transverse position, is easy to manufacture, requiring a smaller number of parts and is capable of being manufactured at a reduced cost.

To attain the above object, the present invention provides a cast cylinder head of a water-cooled internal combustion engine, having an intake-side side wall, an exhaust-side side wall, opposite end walls perpendicular to the intake-side side wall and the exhaust-side side wall, and a water jacket surrounded by the side walls and the end walls; wherein a first cooling water exit part is formed by casting on one of the intake-side side wall and the exhaust-side side wall, the cast first cooling water exit part having a solid structure and being configured to be visually recognizable; a second cooling water exit part is formed by casting on one of the end walls, the cast second cooling water exit part having a solid structure and being configured to be visually recognizable; and at least one machined exit opening is formed selectively in one of the first cooling water exit part and the second cooling water exit part depending on a position in which the internal combustion engine is to be mounted on a vehicle.

Any openings are not formed in both the first and the second cooling water exit part of the cylinder head as cast. Openings are drilled selectively in either of the first and the second cooling water exit part depending on a position in which the water-cooled internal combustion engine is to be installed in a vehicle. Therefore, the cylinder head does not need to be drilled during a cylinder head manufacturing process and hence the cylinder head can be easily manufactured and the proper one of the first and the second cooling water exit part may be drilled when the cylinder head is to be combined with a water cooled internal combustion engine. Therefore, the manufacture of the cylinder head does not need many machining man-hours, any blocking members, such as plugs or covers, are unnecessary, troublesome work, such as plugging work, is unnecessary, and the cost can be significantly reduced.

In a preferred mode of the present invention, the first cooling water exit part and the second cooling water exit part are formed to protrude outward.

Preferably, each of the first cooling water exit part and the second cooling water exit part has at least two mounting bosses, and a cooling water outlet member is attached, using the mounting bosses, to one of the first cooling water exit part and the second cooling water exit part, in which the exit opening is formed.

The first cooling water exit part and the second cooling water exit part may have end surfaces which are flush with surfaces of the mounting bosses to thereby form flat mounting surfaces.

In a preferred form of the invention, each of the first cooling water exit part and the second cooling water exit part is a structure having a rib or a groove, which is formed either on or in an outer surface of one of the intake-side side wall and the exhaust-side side wall, or on or in an outer surface of one of the end walls, around a contour of the exit opening.

In a preferred mode of the present invention, a plurality of exit openings separated by a separation wall may be formed in either of the first and the second cooling water exit part.

Preferably, those exit openings have different sizes, respectively.

Those exit openings may be round holes separated, respectively, by separation walls, and the thickness of each of the separation walls separating the two adjacent ones of the plurality of exit openings may gradually increase from the middle toward the opposite ends of the same separation wall.

When the plurality of exit openings formed in the first or the second cooling water exit part are separated by the separation walls each having thickness gradually increasing from the middle toward the opposite ends thereof, the exit openings can be formed in large sizes, respectively, and can be defined by a rigid structure. When the exit openings are round, the exit openings can be easily formed and the separation walls each having thickness gradually increasing from the middle toward the opposite ends thereof can be naturally formed between the adjacent ones of the exit openings.

The plurality of exit openings are drilled in the cylinder head, a gasket provided with openings corresponding to the exit openings is placed between the joining surface of the cylinder head in which the exit openings opens and a cooling water outlet member, and then the cooling water outlet member is fastened to the cylinder head. Thus, the cooling water outlet member is fixed firmly to the cylinder head and the gasket clamped between the cylinder head and the cooling water outlet member ensures tight sealing.

In another aspect of the invention, there is provided a method of manufacturing a cylinder head of a water-cooled internal combustion engine, the cylinder head including an intake-side side wall, an exhaust-side side wall, opposite end walls perpendicular to the intake-side side wall and the exhaust-side side wall, and a water jacket surrounded by the side walls and the end walls, wherein the method comprises the steps of: casting the cylinder head to have a first cooling water exit part of a solid structure formed on one of the intake-side side wall and the exhaust-side side wall and to have a second cooling water exit part of a solid structure formed on one of the end walls; and machining at least one cooling water exit opening selectively in one of the first cooling water exit part and the second cooling water exit part depending on a position in which the internal combustion engine is to be mounted on a vehicle.

When the internal combustion engine is intended to be installed in a longitudinal position in a vehicle with its crankshaft extended longitudinally, the largest exit opening having the largest sectional area through which cooling water flows into the radiator among the plurality of exit openings may be formed in the first exit part is formed on the downstream side of the main flow of cooling water flowing in a direction in which the crankshaft is extended through the water jacket toward the first cooling water exit part.

When the internal combustion engine is installed in a longitudinal position in a vehicle, the plurality of exit openings are thus formed in the first cooling water exit part on the intake-side or the exhaust-side side wall, the water jacket can be connected to the radiator disposed in front of the internal combustion engine by a short pipe. When the largest exit opening having the largest sectional area through which cooling water flows toward the radiator among the plurality of exit openings is thus formed on the downstream side of the main flow of cooling water flowing in a direction parallel to the crankshaft through the water jacket toward the first cooling water exit part, the flow of cooling water is bent perpendicularly and most part of cooling water flows through the largest exit opening formed in the first cooling water exit part on the intake-side or the exhaust-side side wall toward the radiator. Therefore, cooling water flows at a sufficiently high flow rate from the water jacket of the cylinder head into the radiator.

When the internal combustion engine is intended to be installed in a transverse position in a vehicle with its crankshaft extended transversely, the largest exit opening having the largest sectional area through which cooling water flows toward the radiator among the plurality of exit openings formed in the second cooling water exit part may be formed opposite to a part of water jacket through which cooling water flows at the highest flow rate in a direction in which the crankshaft is extended in the water jacket toward the second cooling water exit part.

When the internal combustion engine is installed in a transverse position in a vehicle, the plurality of exit openings are formed in the second cooling water exit part on the end wall perpendicular to the intake-side and the exhaust-side side wall, the water jacket can be connected to the radiator disposed in front of the internal combustion engine by a short pipe. When the largest exit opening having the largest sectional area through which cooling water flows toward the radiator among the plurality of exit openings formed in the second cooling water exit part is formed opposite to a part of water jacket through which cooling water flows at the highest flow rate in a direction in which the crankshaft is extended in the water jacket toward the second cooling water exit part, the main flow flowing at the highest flow rate of the cooling water flows through the largest exit opening toward the radiator. Therefore, cooling water flows at a sufficiently high flow rate from the water jacket of the cylinder head into the radiator.

DESCRIPTION OF THE PREFERRED EMBODIMENTS

Preferred embodiments of the present invention will be described with reference to the accompanying drawings.

An internal combustion engine relating to the present invention is a four-in-line, four-stroke-cycle, water-cooled engine to be installed in a motor vehicle.

Figure 1:
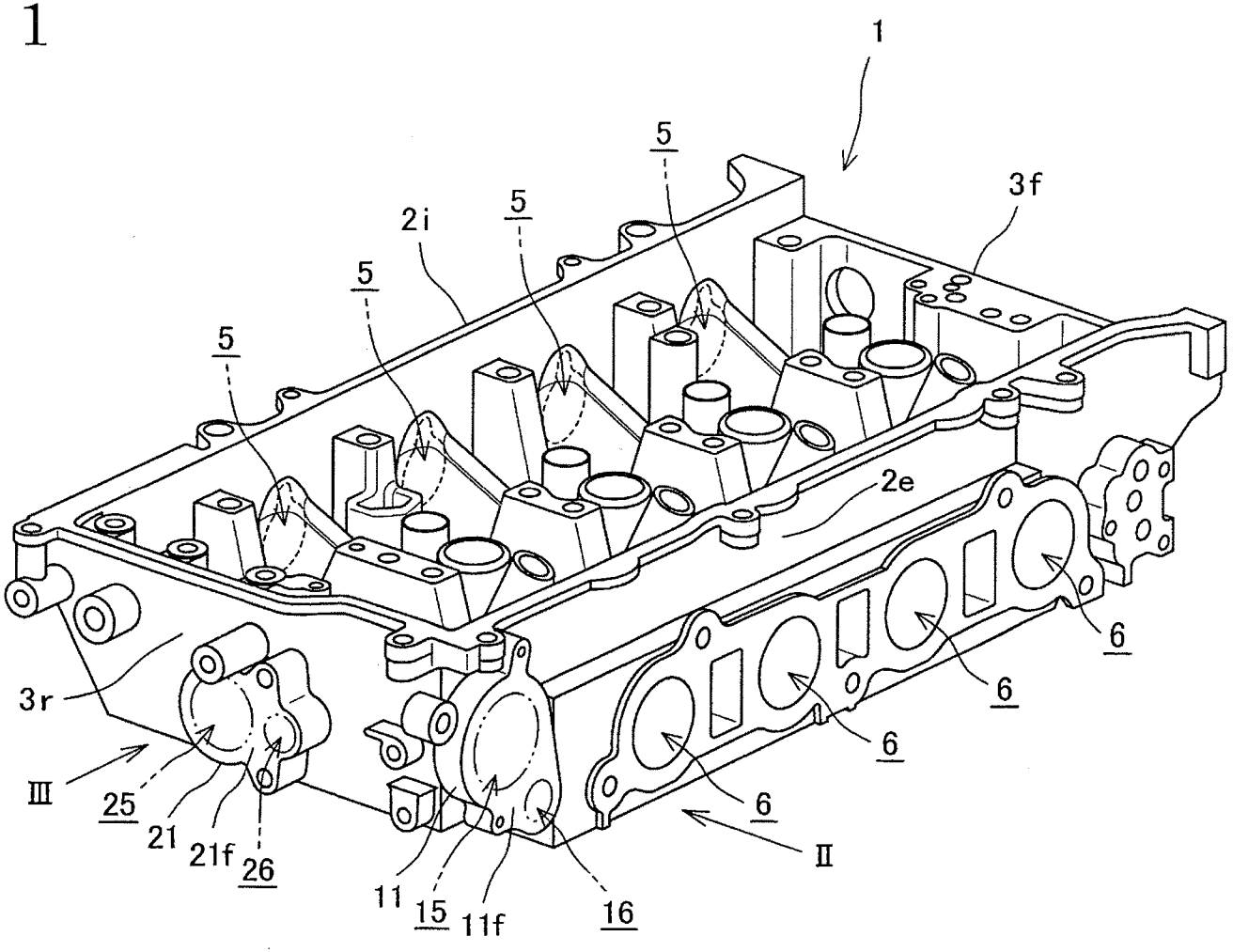
FIG. 1 is a perspective view of a semifinished cylinder head from which is produced a cylinder head of a water-cooled internal combustion engine in a first embodiment of the present invention.

FIG. 1 shows in perspective view a semifinished cylinder head from which a cylinder head 1 is obtained by processing the semifinished cylinder head. The cylinder head 1 is attached to a cylinder block of a water-cooled internal combustion engine. The cylinder head 1 has the shape of a rectangular frame having its length parallel to the crankshaft of the engine. The cylinder head 1 has a pair of parallel longer side walls 2*i* and 2*e*, namely, an inlet-side longer side wall 2*i* and an exhaust-side longer side wall 2*e*, parallel to the crankshaft, and a pair of parallel shorter end walls 2*f* and 2*r*, namely, a front shorter end wall 2*f* and a rear shorter end wall 2*r*, perpendicular to the crankshaft.

Four combustion chambers, not shown, are formed in a row in the joining surface of the cylinder head to be joined to the joining surface of the cylinder block. Intake passages 5 and exhaust passages 6 extend in opposite directions, respectively, from the combustion chambers. The intake passages 5 and the exhaust passages 6 open in the longer side walls 2*i* and 2*e*, respectively.

Figure 4:
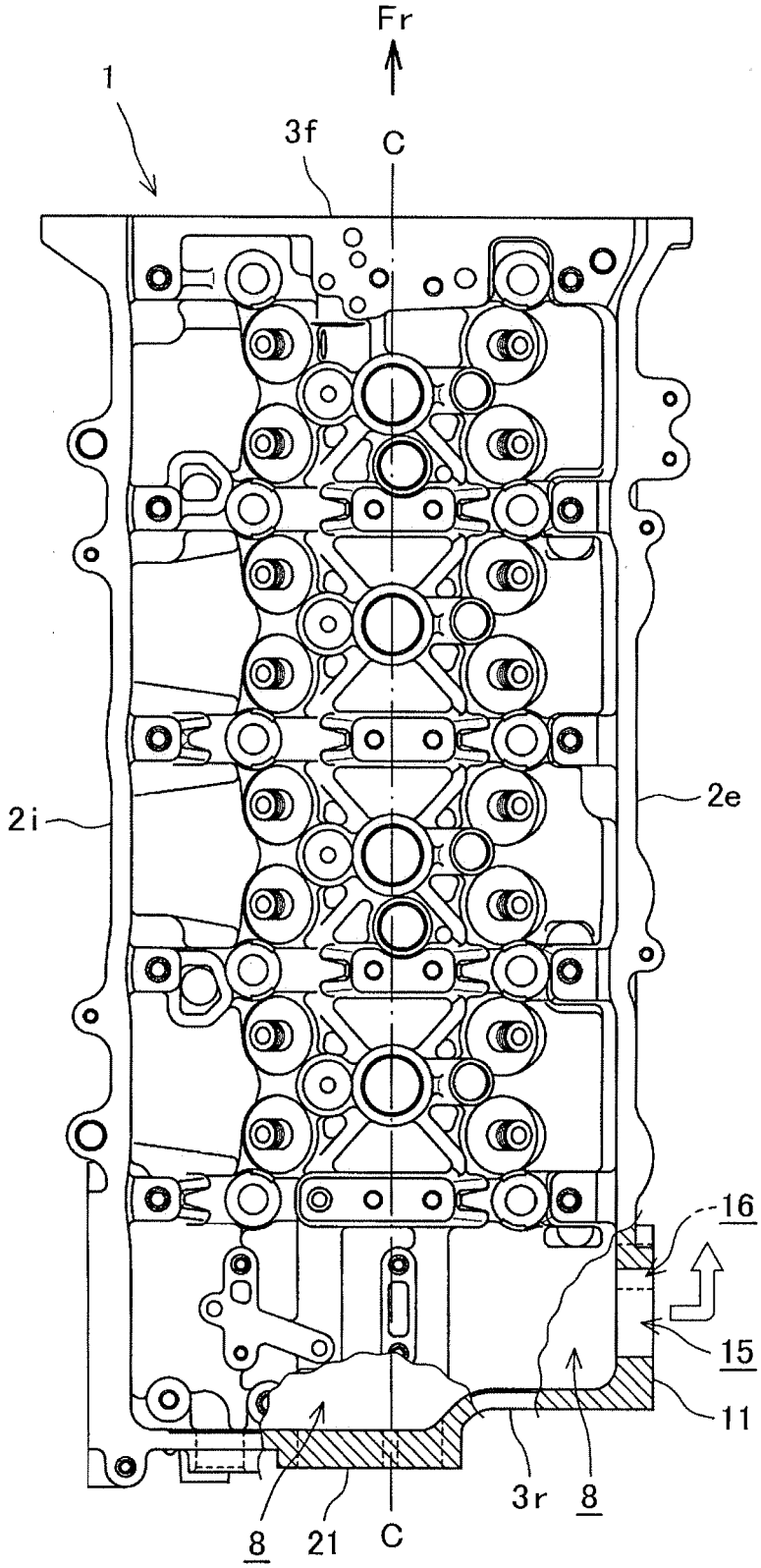
FIG. 4 is a plan view, partly in section, of a cylinder head of a water-cooled internal combustion engine, in a first embodiment of the present invention, to be mounted in a longitudinal position on a vehicle.

Referring to FIG. 4, a water jacket 8, namely an internal water passage through which cooling water flows, is formed in the cylinder head 1. The water jacket 8 surrounds the combustion chambers, the intake passages 5 and the exhaust passages 6. Cooling water flows through the water jacket 8 and picks up heat to cool metal parts of the cylinder head 1.

The internal combustion engine can be mounted on a vehicle in either of a longitudinal position with its crankshaft extending longitudinally of the vehicle and a transverse position with its crankshaft extending transversely of the vehicle.

In this specification, the terms modified by front, rear, right and left are used to designate positions, parts and such in relation with the body of the vehicle regardless of the position of the internal combustion engine on the vehicle.

When the internal combustion engine is installed or mounted in a longitudinal position on the vehicle, the shorter end wall 3*f* is on the front side, the shorter end wall 3*r* is on the rear side. The main flow of cooling water in the water jacket 8 of the cylinder head 1 flows parallel to the crankshaft from a space adjacent to the shorter end wall 3*f* toward a space adjacent to the shorter end wall 3*r* regardless of the mounting position of the internal combustion engine on the vehicle.

A first cooling water exit part 11 having a solid structure is formed integrally with the exhaust-side longer side wall 2*e* so as to protrude outward from a part of the longer side wall 2*e* on the downstream side with respect to the main flow of cooling water. The first cooling water exit part 11 which protrudes outwardly naturally has a thickness increased by the amount of protrusion relative to the general thickness of the longer side wall 2*e*. Since the first cooling water exit part 11 protrudes outward, it is visually recognizable by anyone in distinction from other parts of the exhaust-side longer side wall 2*e*.

Figure 2:
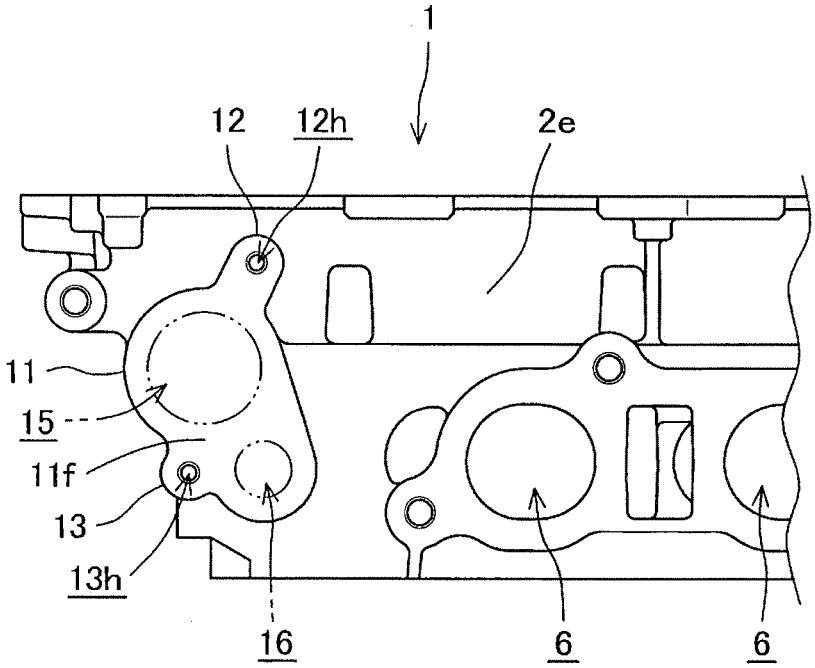
FIG. 2 is a side elevation taken in the direction of the arrow II in FIG. 1.

As shown in FIG. 2 which is a view as seen in the direction of the arrow II in FIG. 1, the first cooling water exit part 11 has a larger circular part, a smaller circular part and a connecting part connecting the larger and the smaller part. The first cooling water exit part 11 has the shape of a deformed elliptical shape delineated by a larger circular arc of a larger circle, a smaller circular arc of a smaller circle and two tangents to the larger and smaller circles. A mounting boss 12 extends obliquely upward from the larger circular part. A mounting boss 13 protrudes obliquely downward from the lower tangential part of the connecting part.

The end surface of the first cooling water exit part 11 having the deformed elliptical shape, the end surfaces of the mounting bosses 12 and 13 are contained in a flat mounting surface 11*f*. The mounting bosses 12 and 13 are provided with threaded holes 12*h* and 13*h*, respectively.

In the cylinder head 1 as cast, any openings are not formed in the first cooling water exit part 11. A round larger exit opening 15 and a round smaller exit opening 16 indicated by two-dot chain lines in FIGS. 1 and 2 can be drilled in the larger and smaller circular parts, respectively. Cooling water can flow to the outside from the water jacket 8 through the larger exit opening 15 and the smaller exit opening 16. Thus the first cooling water exit part 11 is visually recognizable by anyone as a region which is to be machined to form therein the larger exit opening 15 and the smaller exit opening 16.

A second cooling water exit part 21 having a solid structure is formed integrally with the rear shorter end wall 3*r* so as to protrude outward from a middle part of the end wall 3*r* on the downstream side with respect to the main flow of cooling water. The second cooling water exit part 21 which protrudes outwardly naturally has a thickness increased by the amount of protrusion relative to the general thickness of the shorter side wall 3*r*. Since the second cooling water exit part 21 protrudes outward, it is visually recognizable by anyone in distinction from other parts of the shorter side wall 3*r*.

Figure 3:
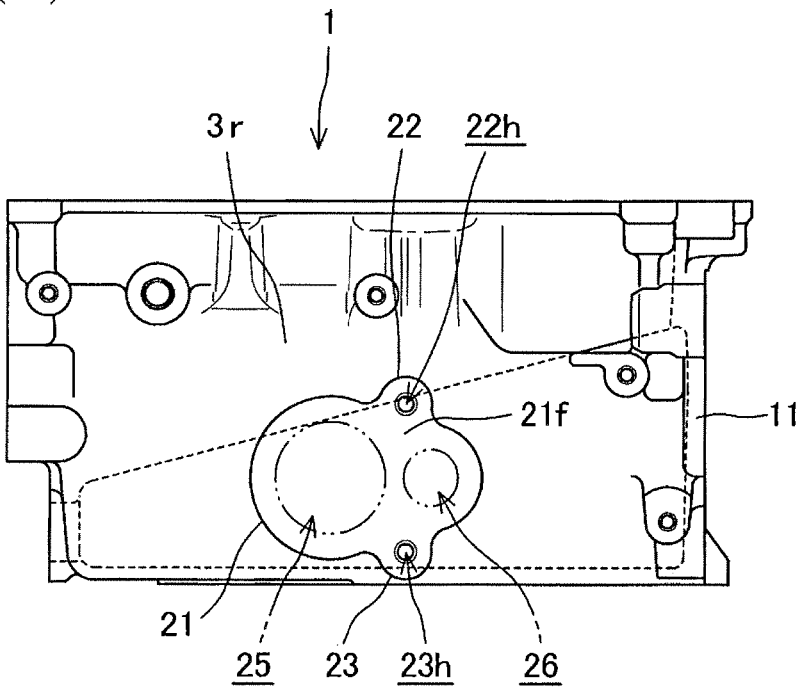
FIG. 3(A) is an end view taken in the direction of the arrow III in FIG. 1.
FIGS. 3(B) and 3(C) show modifications of the structure shown in FIG. 3(A)
Figure 3:
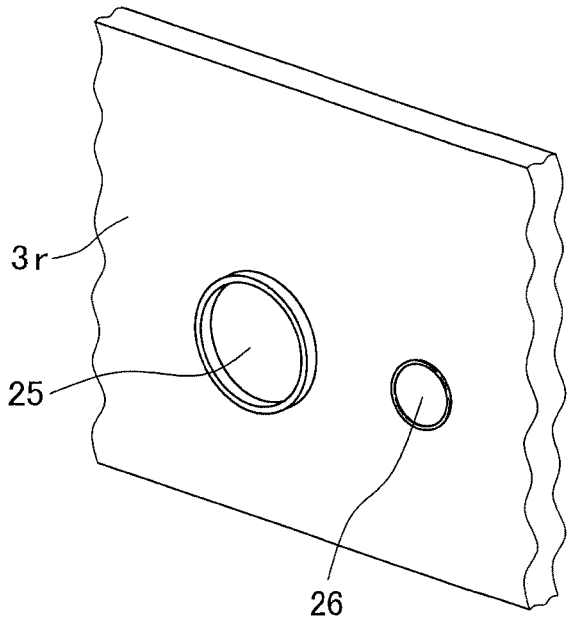
Figure 3:
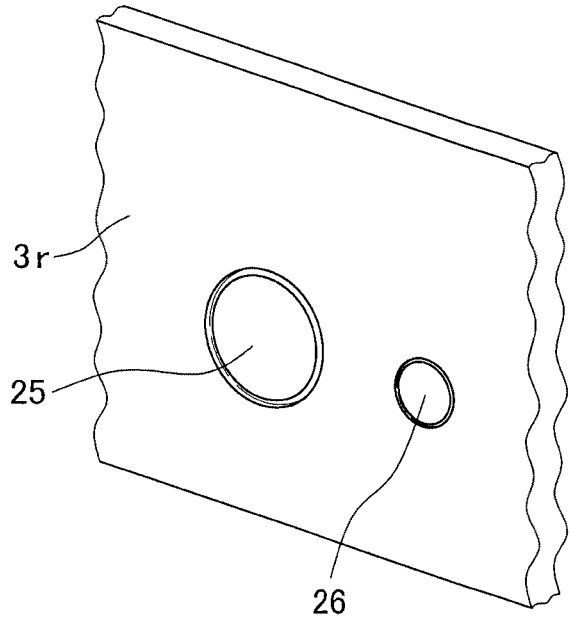

As shown in FIG. 3, which is a view as seen in the direction of the arrow III in FIG. 1, the second cooling water exit part 21 has a larger circular part, a smaller circular part and a connecting part connecting the larger and smaller parts. The second cooling water exit part 21 has the shape of a deformed elliptical shape delineated by a larger circular arc of a larger circle, a smaller circular arc of a smaller circle and two tangents to the larger and smaller circles. A mounting boss 22 extends upward from the upper tangential part of the connecting part. A mounting boss 23 protrudes downward from the lower tangential part of the connecting part.

The end surface of the second cooling water exit part 21 having the deformed elliptical shape, the end surfaces of the mounting bosses 22 and 23 are contained in a flat mounting surface 21*f*. The mounting bosses 22 and 23 are provided with threaded holes 22*h* and 23*h*, respectively.

In the cylinder head 1 as cast, any openings are not formed in the second water exit part 21. A round larger exit opening 25 and a round smaller exit opening 26 indicated by two-dot chain lines in FIGS. 1 and 3 can be drilled in the larger and smaller circular parts, respectively. Cooling water can flow to the outside from the water jacket 8 through the round larger exit opening 25 and the round smaller exit opening 26. Thus the second cooling water exit part 21 is visually recognizable by anyone as a region which is to be machined to form therein the larger exit opening 25 and the smaller exit opening 26.

In the embodiment shown, the first cooling water exit part 11 and the second cooling water exit part 21 are formed to protrude outward to enable visual recognition of these parts as regions in which the exit openings are to be machined. However it is possible to adopt other means for enabling visual recognition of these cooling water exit parts than the outward protrusion of these parts. In the embodiment shown in FIG. 1, the first and second water exit parts 11 and 21 have entirely outwardly protruding flat end surfaces, but the first and second water exit parts 11 and 21 may be formed without outward protrusion. For example, the first and second water exit parts 11 and 21 can be made by forming annular or similar ribs or grooves formed on or in the outer surfaces of the walls 2*e* and 3*r* around the contours of the exit openings 15, 16; 25, 26 to be formed. Such ribs or grooves ensure visual recognition of the first and second water exit parts 11 and 21 where the exit openings are to be formed. FIG. 3(B) shows a modification in which annular ribs 25*a* and 26*a* are formed along or around the contours of the exit openings 25 and 26 to be drilled, of the second water exit part 21. FIG. 3(C) shows a further modification in which annular grooves 25*b* and 26*b* are formed along or around the contours of the exit openings 25 and 26 to be drilled, of the second water exit part 21.

When the internal combustion engine is mounted in a longitudinal position on the vehicle, the shorter end walls 3*f* and 3*r* perpendicular to the axis C-C of the crankshaft are on the front and rear sides, respectively. A radiator, not shown, is disposed in front of the front shorter end wall 3*f*.

FIGS. 4 to 8 show the cylinder head 1 in a state where the internal combustion engine is mounted in a longitudinal position on the vehicle.

Figure 5:
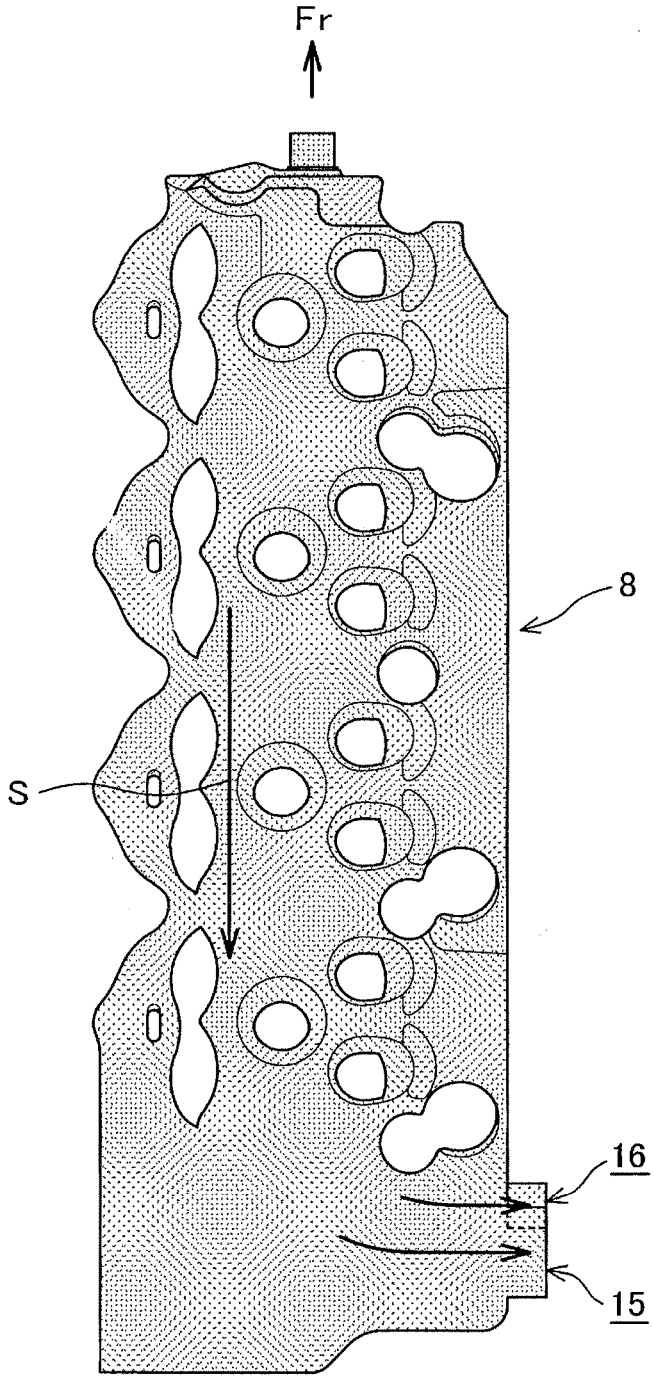
FIG. 5 is a plan view of a water jacket formed in the cylinder head shown in FIG. 4.

FIG. 5 is a plan view of the water jacket 8 which is an internal water passage of the cylinder head through which cooling water flows. The water jacket 8 has parts indicated by hollows respectively corresponding to intake passages 5, exhaust passages 6, valve guides and spark plugs.

Cooling water flows from the front side to the rear side substantially parallel to the crankshaft in the water jacket 8. The main flow S having the greatest flow rate of the cooling water flows rearward through apart having the fewest obstacles in the water jacket 8 as indicated by the arrow in FIG. 5.

As indicated in FIG. 4, cooling water exit openings 15 and 16 are formed in the first cooling water exit part 11 on the exhaust-side longer side wall 2*e*. The first cooling water exit part 11 is nearer to the radiator disposed in front of the shorter end wall 3*f* than the second cooling water exit part 21 on the shorter end wall 3*r*. The cooling water exit openings formed in the first cooling water exit part 11 can be connected to the radiator by a shorter pipe.

When the internal combustion engine is to be mounted in a longitudinal position on the vehicle, the larger exit opening 15 and the smaller exit opening 16 are machined or drilled in the first cooling water exit part 11 as shown in FIG. 4.

Figure 6:
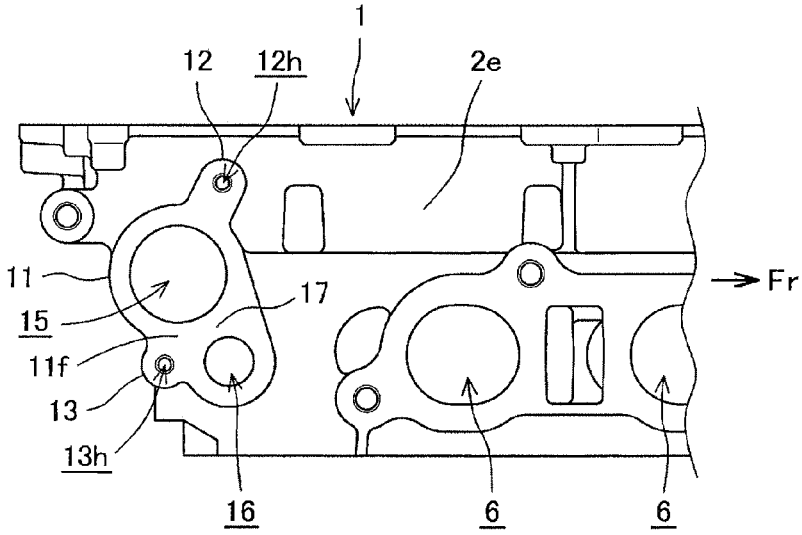
FIG. 6 is a right side elevation of the cylinder head shown in FIG. 4.

Referring to FIG. 6, the larger exit opening 15 is obliquely above the smaller exit opening 16 and is on the downstream side of the round smaller exit opening 16 with respect to the direction of the main flow S of cooling water.

Since the larger exit opening 15 and the smaller exit opening 16 are round, a separation wall 17 separating the larger exit opening 15 and the smaller exit opening 16 naturally has a thickness gradually increasing from the middle part toward the opposite ends thereof.

Thus, high rigidity of the first cooling water exit part can be ensured even though the larger exit opening 15 and the smaller exit opening 16 are formed to have large diameters, respectively.

Figure 7:
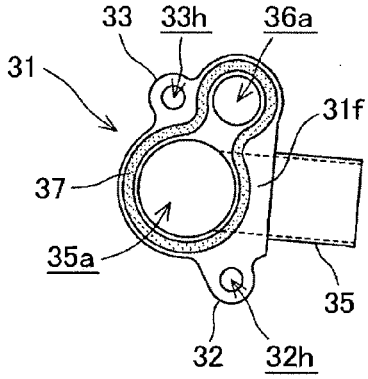
FIG. 7 is a rear view of a cooling water outlet member.

A cooling water outlet member 31 shown in FIG. 7 is attached to the mounting surface 11*f* of the first cooling water exit part 11. The round larger exit opening 15 and the round smaller exit opening 16 are formed in the mounting surface 11*f*.

Figure 8:
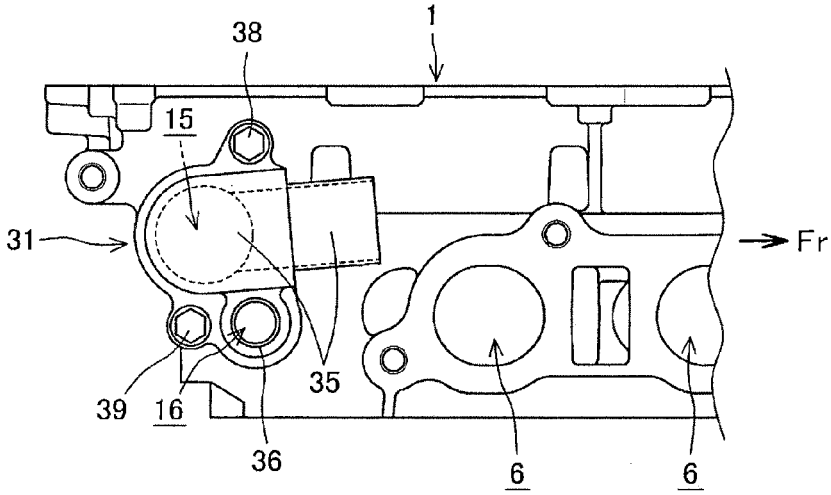
FIG. 8 is a right side elevation of the cylinder head with the cooling water outlet member attached thereto.

Referring to FIGS. 7 and 8, the cooling water outlet member 31 has a joining surface 31*f* of the same shape as the mounting surface 11*f* of the first cooling water exit part 11. A larger opening 35*a* and a smaller opening 36*a* are formed in the joining surface 31*f* so as to coincide with the larger exit opening 15 and the smaller exit opening 16, respectively. The cooling water outlet member 31 has mounting lugs 32 and 33 respectively coinciding with the mounting bosses 12 and 13. The mounting lugs 32 and 33 are provided with bolt holes 32*h* and 33*h*, respectively.

A continuous groove is formed in the joining surface 31*f* of the cooling water outlet member 31 around the larger opening 35*a* and the smaller opening 36*a*. An endless sealing member 37 is fitted in the continuous groove.

The cooling water outlet member 31 has a bent tubular part 35 and a straight tubular part 36. The interior of the bent tubular part 35 connects to the larger opening 35*a* formed in the joining surface 31*f*. The interior of the straight tubular part 36 connects to the smaller opening 36*a*.

The joining surface 31*f* of the cooling water outlet member 31 is joined to the mounting surface 11*f* of the first cooling water exit part 11 with the continuous sealing member 37 held between the joining surface 31*f* and the mounting surface 11*f*. Then, bolts 38 and 39 are screwed through the bolt holes 32*h* and 33*h* of the mounting lugs 32 and 33 into the threaded holes 12*h* and 13*h* of the mounting bosses 12 and 13, respectively, to fasten the cooling outlet member 31 firmly to the first cooling water exit part 11.

The continuous sealing member 37 extending around the larger exit opening 15 and the smaller exit opening 16 is clamped between the mounting surface 11*f* in which the larger exit opening 15 and the smaller exit opening 16 open when the cooling water outlet member 31 is attached to the mounting surface 11*f*. Thus, a satisfactory sealing effect can be easily ensured and the cooling water outlet member 31 can be firmly fixed to the first cooling water exit part 11.

When the cooling water outlet member 31 is attached to the first cooling water exit part 11, the bent tubular part 35 extends to the right from the larger opening 35*a* connected to the larger exit opening 15, and then bends so as to extend to the front. A radiator hose, not shown, connects a connecting part extending to the front of the cooling water outlet member 31 to the radiator. Thus, the radiator hose may be short and can be easily arranged.

Cooling water that flows out through the larger exit opening 15 of the first cooling water exit part 11 flows to the radiator. Cooling water that flows out through the smaller exit opening 16 of the first cooling water exit part 11 flows through the straight tubular part 36 and a hose to the heating unit of an air conditioning system. In the case of the modification shown in FIG. 3(B), in which annular ribs are formed, the cooling water outlet member 31 is preferably fixed by pressure fit rather than the bolt tightening.

Cooling water flows through the water jacket 8 shown in FIG. 5 from the front side toward the rear side parallel to the crankshaft. The larger exit opening 15 and the smaller exit opening 16 are formed in a part, on the downstream side with respect to the direction of the main flow S, of the right-side longer side wall 2*e*, namely, the exhaust-side longer side wall. The main flow S flows rearward, and then changes the flowing direction perpendicularly to the right. Then, the main flow is divided into two flows by the separation wall 17. The two flows are straightened. The straightened flows flow out through the larger exit opening 15 and the smaller exit opening 16.

Since the larger exit opening 15 is on the downstream side of the smaller exit opening 16 with respect to the flowing direction of the main stream, a greater part of the main flow of cooling water is caused to flow toward the larger exit opening 15, when curving toward the exhaust side, so that a sufficiently high flow rate of cooling water into the radiator is ensured.

Figure 9:
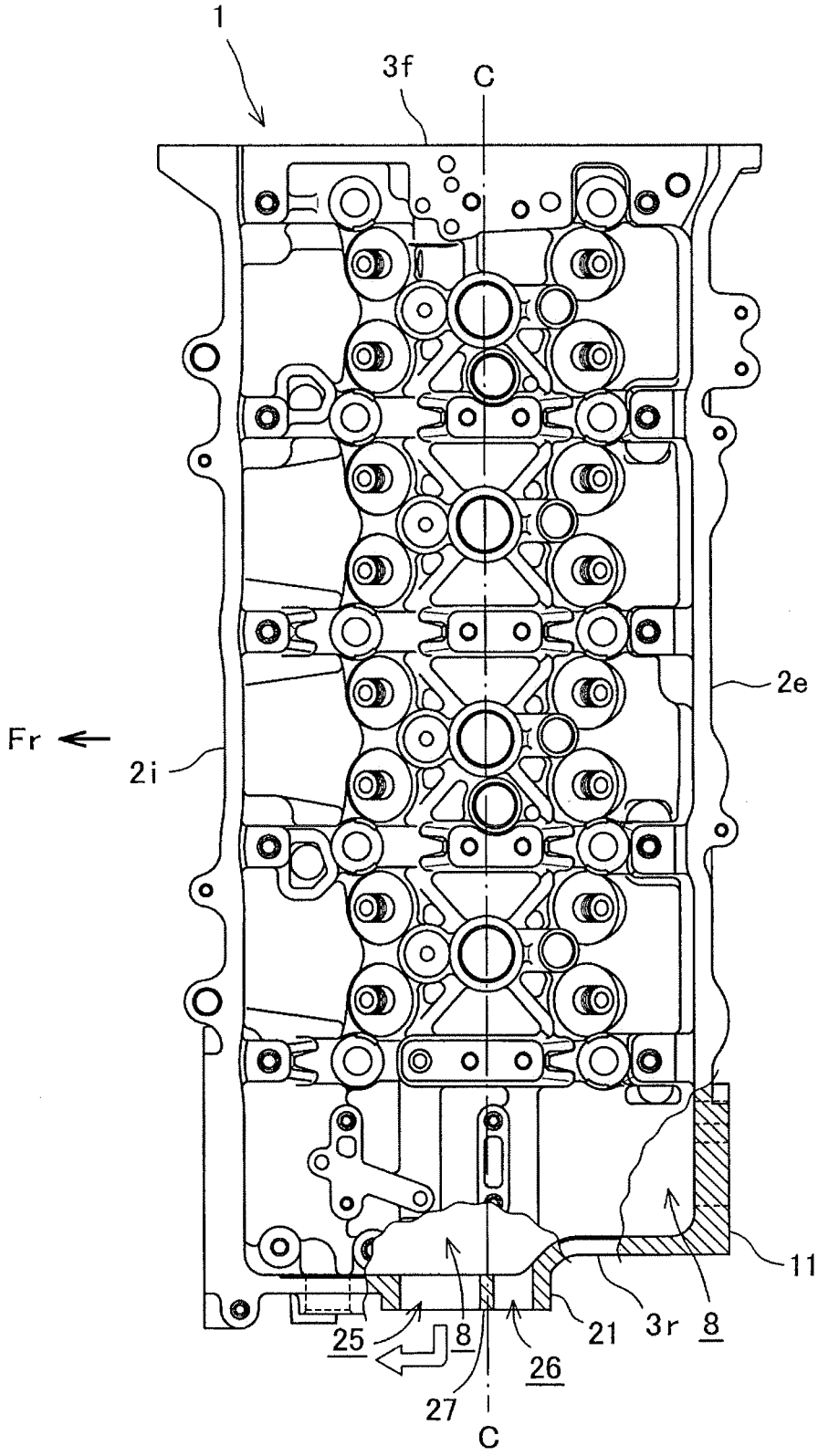
FIG. 9 is a plan view, partly in section, of a cylinder head of a water-cooled internal combustion engine, in a second embodiment of the present invention, to be mounted in a transverse position on a vehicle.

When the internal combustion engine is mounted in a transverse position on a vehicle, the cylinder head 1 is disposed as shown in FIG. 9, in which the intake-side longer side wall 2*i* parallel to the axis C-C of the crankshaft extends on the front side and the exhaust side longer side wall 2*e* parallel to the axis C-C of the crankshaft extends on the rear side. A radiator, not shown, is disposed in front of the intake-side longer side wall 2*i*.

FIGS. 9 to 13 show the cylinder head 1 in a state where the internal combustion engine is mounted in a transverse position on the vehicle.

Figure 10:
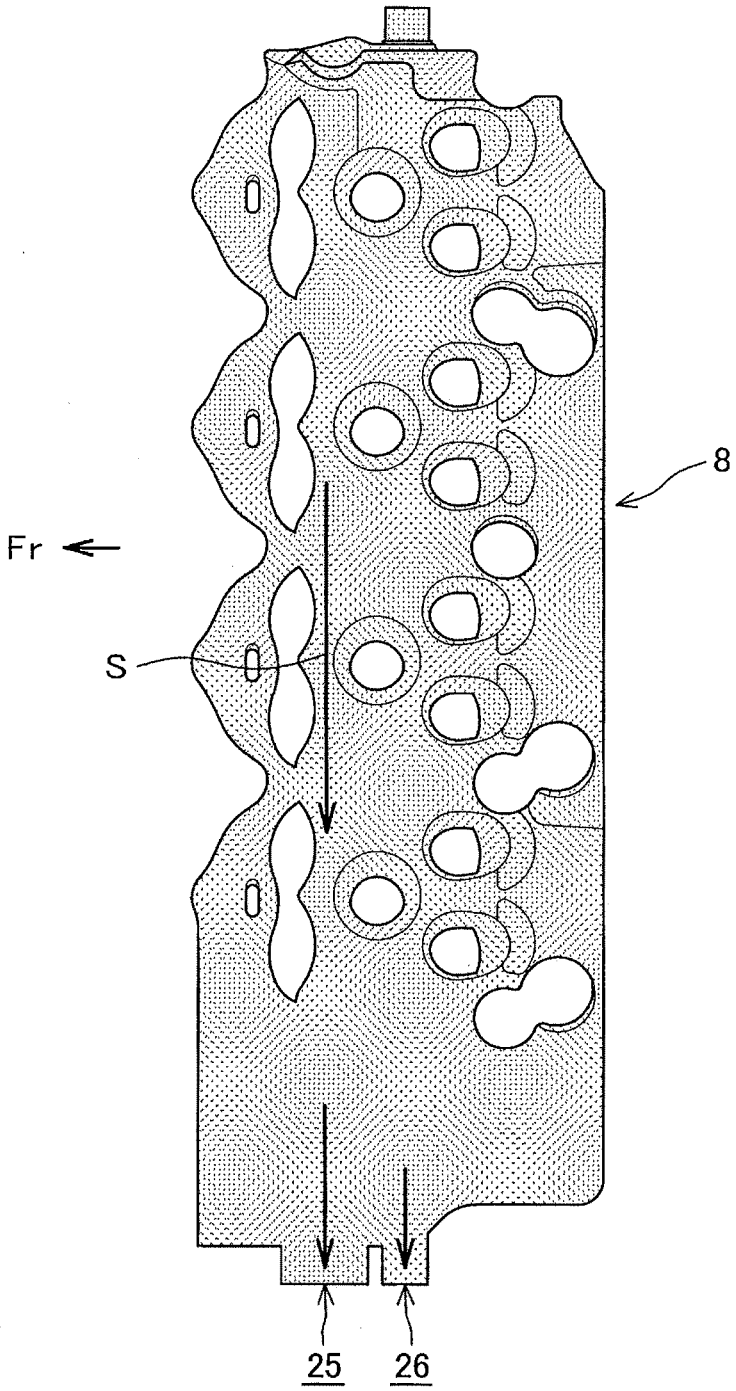
FIG. 10 is a plan view of a water jacket formed in the cylinder head shown in FIG. 9.

FIG. 10 is a plan view of a water jacket 8 having the same shape as the water jacket 8 shown in FIG. 5. Cooling water flows leftward substantially parallel to the crankshaft in the water jacket 8. The main flow S of the cooling water, similarly to the main flow S shown in FIG. 5, flows from the right side to the left side through a part having the fewest obstacles in the water jacket 8 as indicated by the arrow in FIG. 9.

In this case, as indicated in FIG. 9, the second cooling water exit part 21 formed on the shorter end wall 3*r* is nearer to the radiator disposed in front of the intake-side longer side wall 2*i* than the first cooling water exit part 11. Therefore, the second cooling water exit part 21 that can be connected by a short radiator hose to the radiator is used as a cooling water exit part.

When the internal combustion engine is to be mounted in a transverse position on a vehicle, the larger exit opening 25 and the smaller exit opening 26 are formed in the second cooling water exit part 21, as shown in FIG. 9.

Figure 11:
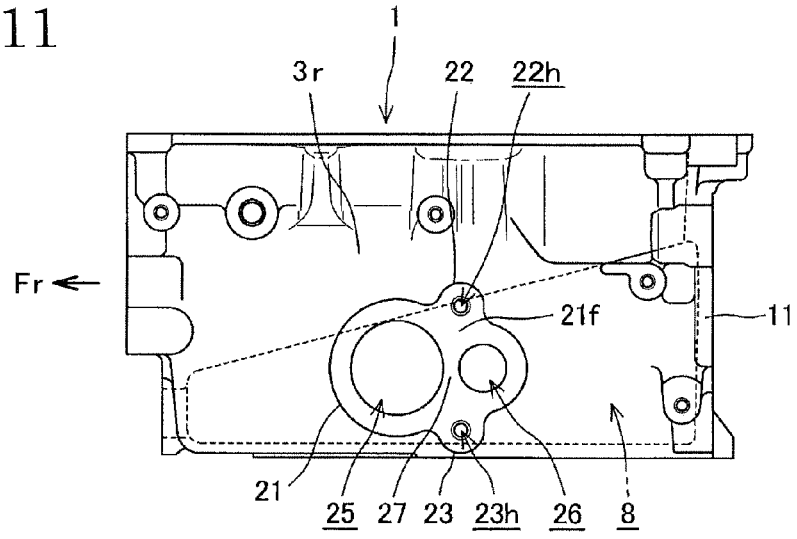
FIG. 11 is a left side elevation of the cylinder head shown in FIG. 9.

As shown in FIG. 11, the round larger exit opening 25 and the round smaller exit opening 26 are drilled in the second cooling water exit part 21 in substantially a middle part, with respect to the longitudinal direction, of the left shorter end wall 3*r*.

Since the larger exit opening 25 and the smaller exit opening 26 are round, a separation wall 27 separating the larger exit opening 25 and the smaller exit opening 26 naturally has a thickness gradually increasing from the middle part toward the opposite ends thereof.

Thus, high rigidity of the first cooling water exit part 21 can be ensured even though the larger exit opening 25 and the smaller exit opening 26 are formed to have large diameters, respectively.

Figure 12:
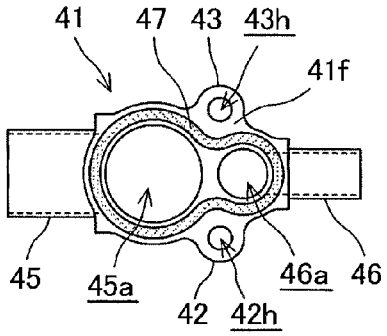
FIG. 12 is a rear view of a cooling water outlet member.
Figure 13:
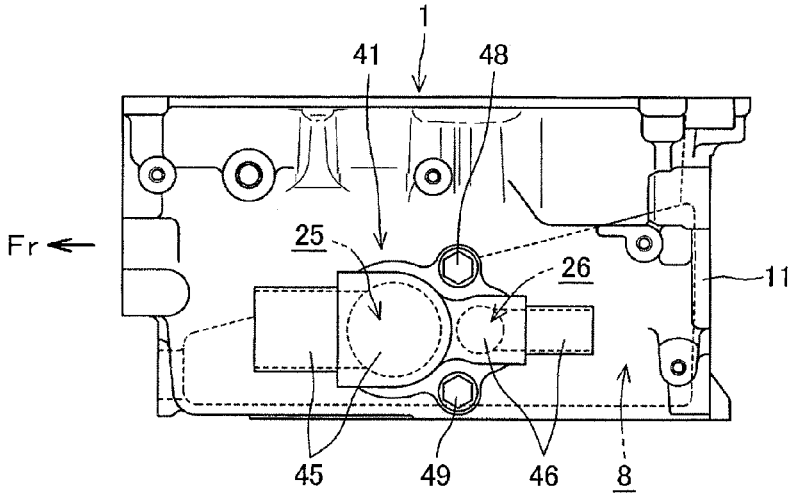
FIG. 13 is a left side elevation of the cylinder head shown in FIG. 9 with the cooling water outlet member attached thereto.

A cooling water outlet member 41 shown in FIG. 12 is attached to a mounting surface 21*f*, in which the round larger exit opening 25 and the round smaller exit opening 26 are formed, of the second cooling water exit part 21.

Referring to FIGS. 11 and 12, the cooling water outlet member 41 has a joining surface 41*f* of the same shape as the mounting surface 21*f* of the second cooling water exit part 21. A larger opening 45*a* and a smaller opening 46*a* are formed in the joining surface 41*f* so as to coincide with the larger exit opening 25 and the smaller exit opening 26, respectively. The cooling water outlet member 41 has mounting lugs 42 and 43 respectively coinciding with the mounting bosses 22 and 23. The mounting lugs 42 and 43 are provided with bolt holes 42*h* and 43*h*, respectively.

A continuous groove is formed in the joining surface 41*f* of the cooling water outlet member 41 around the larger opening 45*a* and the smaller opening 46*a*. An endless sealing member 47 is fitted in the continuous groove.

The cooling water outlet member 41 has a larger bent tubular part 45 and a smaller bent tubular part 46 of an inside diameter smaller than that of the larger tubular part 45. The interior of the larger tubular part 45 connects to the larger opening 45*a* formed in the joining surface 31*f*. The interior of the smaller tubular part 46 connects to the smaller opening 46*a*.

The joining surface 41*f* of the cooling water outlet member 41 is joined to the mounting surface 21*f* of the second cooling water exit part 21 with the continuous sealing member 47 held between the joining surface 41*f* and the mounting surface 21*f*. Then, bolts 48 and 49 are screwed through the bolt holes 42*h* and 43*h* of the mounting lugs 42 and 43 into the threaded holes 22*h* and 23*h* of the mounting bosses 22 and 23, respectively, to fasten the cooling outlet member 41 firmly to the second cooling water exit part 21.

The continuous sealing member 47 extending around the larger exit opening 25 and the smaller exit opening 26 is clamped between the mounting surface 21*f* in which the larger exit opening 25 and the smaller exit opening 26 open when the cooling water outlet member 41 is attached to the mounting surface 21*f*. Thus, a satisfactory sealing effect can be easily ensured and the cooling water outlet member 41 can be firmly fixed to the second cooling water exit part 21.

When the cooling water outlet member 41 is attached to the second cooling water exit part 21, the larger, bent, tubular part 45 extends to the left from the larger opening 45*a* connected to the larger exit opening 25, and then bends so as to extend to the front. A radiator hose, not shown, connects a part extending to the front of the larger tubular part 45 to the radiator. Thus, the radiator hose may be short and can be easily arranged.

Thus cooling water that flows out through the larger exit opening 25 of the second cooling water exit part 21 flows to the radiator.

The smaller, bent tubular part 46 extends to the left from the smaller opening 45*a* connecting to the smaller exit opening 26 opening to the left, and then the smaller, bent tubular part 46 bends so as to extend rearward. A part extending rearward of the smaller, bent tubular part 46 is connected by a hose to the heating unit of an air conditioner.

As shown in FIG. 10, cooling water flows in the water jacket 8 from the right side toward the left side parallel to the crankshaft. The larger exit opening 25 and the smaller exit opening 26 are formed in a part of the shorter end wall 3*r* on the downstream side with respect to the flow of the main flow S of cooling water. The main flow flows from the right side toward the left side, and then the main flow is divided into two flows by the separation wall 27. The two flows are straightened. The straightened flows flow out through the larger exit opening 25 and the smaller exit opening 26.

Since the larger exit opening 25 is nearer to the strongest main flow S than the smaller exit opening 26, in other words, the larger exit opening 25 faces the direction of the strongest main flow S, a greater part of the main flow S of cooling water is caused to flow through the larger exit opening 25 toward the radiator, so that a sufficiently high flow rate of the flow of cooling water into the radiator is ensured.

As mentioned above, any openings are not formed in the first cooling water exit part 11 and the second cooling water exit part 21 on the cylinder head 1 as cast. The openings are machined or drilled selectively in the first cooling water exit part 11 or the second cooling water exit part 21 depending on a position in which the internal combustion engine is to be mounted on the vehicle, and hence the cylinder head 1 can be easily manufactured by casting. The exit openings are machined or drilled in the suitable cooling water exit part when the cylinder block 1 is used, and hence the manufacture of the cylinder head does not need many machining man-hours. The cylinder head 1 does not need any auxiliary parts including blocking members, such as plugs and covers, at all, does not require any troublesome work, such as plugging work and can be manufactured at a greatly reduced cost.

A second cooling water exit part 61 in a modification of the second cooling water exit part 21 will be described with reference to FIGS. 14 and 15.

A cylinder head 51 is the same as the cylinder head 1, except that the cylinder head 51 is provided with the second cooling water exit 61 different in shape from the second cooling water exit part 21.

The second cooling water exit part 61 is formed on a shorter end wall 53*r* and is provided with a larger exit opening 65 and a smaller exit opening 66 formed by machining or drilling. The shorter end wall 53*r* is on the left side when the internal combustion engine is mounted in a transverse position on the vehicle.

Figure 14:
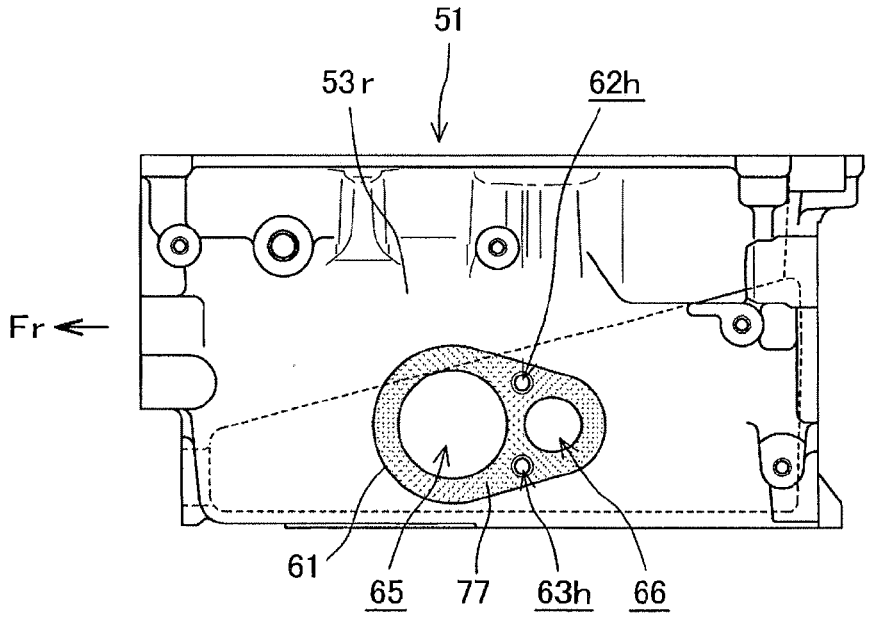
FIG. 14 is a left-side elevation of a cylinder head in a third embodiment of the present invention.
Figure 15:
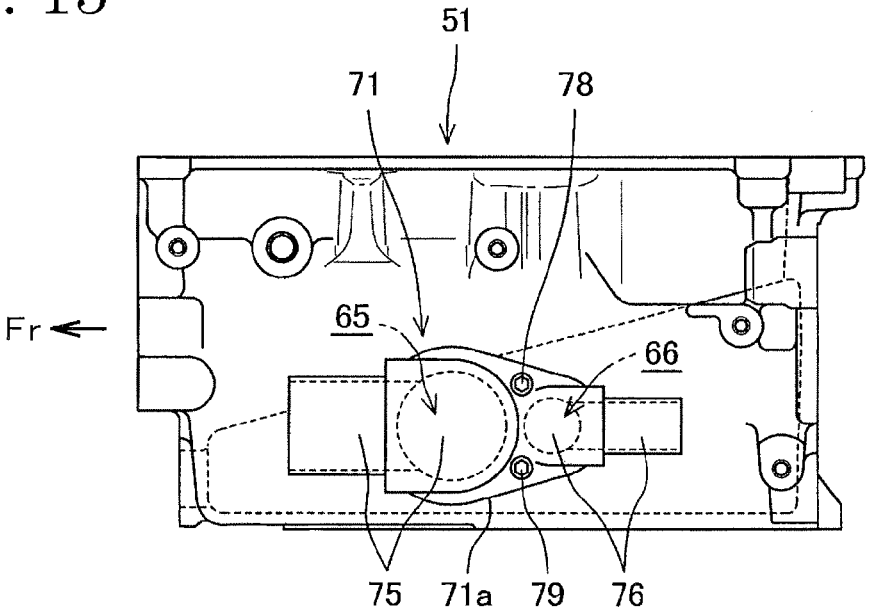
FIG. 15 is a left side elevation of the cylinder head shown in FIG. 14 with a cooling water outlet member attached thereto.

Referring to FIG. 14, the second cooling water exit part 61 has a deformed elliptical shape having a larger, circular part on the front side, a smaller, circular part on the rear side and tangents to the larger, circular part and the smaller, circular part. The second cooling water exit part 61 differs from the second cooling water exit part 21 in that any mounting bosses do not protrude outward from the upper and lower tangents. Threaded holes 62*h* and 63*h* are formed on the inner side of the tangents.

A larger exit opening 65 is drilled in the front-side larger, circular part concentrically with the larger, circular part, and a smaller exit opening 66 is drilled in the rear-side, smaller, circular part concentrically with the smaller, circular part.

A round larger exit opening 65, a round smaller exit opening 65 and threaded holes 62*h* and 63*h* are formed in the mounting surface of the second cooling water exit part 61. A cooling water outlet member 71 is attached to the mounting surface of the second cooling water exit part 61 with a sealing sheet 77 of the same shape as the mounting surface clamped between the mounting surface and the cooling water outlet member 71.

The cooling water outlet member 71 has a base 71*a* having a joining surface of the same shape as the mounting surface of the second cooling water exit part 61 and the sealing sheet 77. Through holes are formed in upper and lower parts of the base 71*a*. A larger, bent tubular part 75 and a smaller, bent, tubular part 76 rise from the base 71*a*

The sealing member 77 and the cooling water outlet member 71 are placed in that order on the mounting surface of the second cooling water exit part 61, and then bolts 78 and 79 are screwed through the through holes into the threaded holes 62*h* and 63*h* to fasten the cooling water outlet member 71 to the second cooling water exit part 61.

When the cooling water outlet member 71 is thus attached to the second cooling water exit part 61, the interior of the larger, bent, tubular part 75 connects to the larger exit opening 65 of the second cooling water exit part 61. The larger, bent, tubular part 75 extends to the left and bends forward in a connecting part. A radiator hose, not shown, connects the connecting part of the larger, bent, tubular part 75 to a radiator, not shown, disposed in front of the cylinder head 51.

The interior of the smaller, bent, tubular part 76 connects to the smaller exit opening 66 of the second cooling water exit part 61. The smaller, bent tubular part 76 extends to the left and bends rearward in a connecting part. A hose, not shown, connects the connecting part of the smaller, bent, tubular part 76 to the heating unit of an air conditioning system.

The larger exit opening 65 and the smaller exit opening 66 of the second cooling water exit part 61 are the same in size and position on the cylinder head as the larger exit opening 25 and the smaller exit opening 26 of the second cooling water exit part 21, respectively. Therefore, the second cooling water exit part 61 can be easily connected to the radiator by a short radiator hose and cooling water flows at a sufficiently high flow rate into the radiator. Thus, the cooling water outlet member 71 is fixed firmly to the second cooling water exit part 61 and the sealing sheet 77 clamped between the second cooling water exit part 61 and the cooling water outlet member 77 ensures tight sealing.

Any mounting bosses corresponding to the mounting bosses of the second cooling water exit part 21 do not protrude from the upper and lower tangential parts of the second cooling water exit part 61, and the threaded holes 62*h* and 63*h* are formed on the inner side of the tangential parts. The cooling water outlet member 71 has the base 71*a* having the joining surface of the same shape as the deformed elliptic mounting surface of the second cooling water exit part 61. Bolts 78 and 79 are screwed through the through holes into the threaded holes 62*h* and 63*h* to fasten the base 71*a* to the second cooling water exit part 61. Thus, the cooling water outlet member 71 can be attached to the second cooling water exit part 61 in a small space.

What is claimed is:

1. A water-cooled internal combustion engine with a cast cylinder head comprising:

an intake-side side wall;

an exhaust-side side wall;

opposite end walls, the opposite end walls perpendicular to the intake-side side wall and the exhaust-side side wall and perpendicular to a crankshaft;

a water jacket surrounded by the side walls and the end walls;

a first cooling water exit part formed by casting on one of the intake-side side wall and the exhaust-side side wall;

a second cooling water exit part formed by casting on one of the end walls; and at least one machined exit opening formed selectively in one of the first cooling water exit part and the second cooling water exit part depending on a position in which the internal combustion engine is to be mounted on a vehicle, wherein each of the first cooling water exit part and the second cooling water exit part has at least two mounting bosses, and a cooling water outlet member is attached, using the mounting bosses, to one of the first cooling water exit part and the second cooling water exit part in which the exit opening is formed.

2. The water-cooled internal combustion engine of claim 1 wherein the first cooling water exit part and the second cooling water exit part are formed to protrude outward.

3. The water-cooled internal combustion engine of claim 1, wherein the first cooling water exit part and the second cooling water exit part have end surfaces which are flush with surfaces of the mounting bosses to thereby form flat mounting surfaces.

4. The water-cooled internal combustion engine of claim 1 wherein each of the first cooling water exit part and the second cooling water exit part is a structure having a rib or a groove, which is formed either on or in an outer surface of one of the intake-side side wall and the exhaust-side side wall, or on or in an outer surface of one of the end walls, around a contour of the exit opening.

5. The water-cooled internal combustion engine of claim 1 wherein a plurality of cooling water exit openings separated by a separation wall are machined in one of the first cooling water exit part and the second cooling water exit part.

6. The water-cooled internal combustion engine of claim 5 wherein the cooling water exit openings have different sizes, respectively.

7. The water-cooled internal combustion engine of claim 5 wherein the plurality of cooling water exit openings are round openings formed by drilling, and each of the separation walls has a thickness gradually increasing from a middle part thereof toward opposite ends thereof.

8. The a water-cooled internal combustion engine of claim 1 wherein a cooling water outlet member is attached to a mounting surface in which the exit openings opens with an endless sealing member surrounding the exit openings clamped between the mounting surface and the cooling water outlet member.

9. A method of manufacturing a water-cooled internal combustion engine with a cylinder head, the cylinder head including an intake-side side wall and an exhaust-side side wall parallel to a crankshaft of the engine, opposite end walls perpendicular to the intake-side side wall and the exhaust-side side wall and perpendicular to the crankshaft, and a water jacket surrounded by the side walls and the end walls, comprising:

casting the cylinder head to have a first cooling water exit part of a solid structure formed on one of the intake-side side wall and the exhaust-side side wall and to have a second cooling water exit part formed on one of the end walls; and machining at least one cooling water exit opening selectively in one of the first cooling water exit part and the second cooling water exit part depending on a position in which the internal combustion engine is to be mounted on a vehicle, wherein each of the first cooling water exit part and the second cooling water exit part has at least two mounting bosses, and a cooling water outlet member is attached, using the mounting bosses, to one of the first cooling water exit part and the second cooling water exit part in which the exit opening is formed.

10. The method of claim 9 wherein a largest exit opening having a largest sectional area, through which cooling water flows toward a radiator, among the plurality of exit openings in the first cooling water exit part, is formed in a part of the first cooling water exit part on a most downstream side of a main cooling water flow parallel to a crankshaft, through the water jacket toward the first cooling water exit part, when the internal combustion engine is to be mounted in a longitudinal position on a vehicle.

11. The method of claim 9 wherein a largest exit opening having a largest sectional area, through which cooling water flows toward a radiator, among the plurality of cooling water exit openings in the second cooling water exit part, is formed in a part of the second cooling water exit part, facing the direction of a main strongest cooling water flow parallel to a crankshaft, through the water jacket toward the second cooling water exit part, when the internal, combustion engine is to be mounted in a transverse position on a vehicle.

* * * * *